US005360075A

United States Patent [19]

Gray

[11] Patent Number: 5,360,075

[45] Date of Patent: Nov. 1, 1994

[54] STEERING DRILL BIT WHILE DRILLING A BORE HOLE

[75] Inventor: Benjamin Gray, Silver Valley, Canada

[73] Assignee: Kidco Resources Ltd., Silver Valley, Canada

[21] Appl. No.: 158,830

[22] Filed: Nov. 29, 1993

[51] Int. Cl.[5] ..... E21B 4/20; E21B 7/04; E21B 17/20

[52] U.S. Cl. ..... 175/61; 175/103; 175/162; 175/203

[58] Field of Search ..... 175/203, 122, 162, 103, 175/172, 61

[56] References Cited

U.S. PATENT DOCUMENTS

| | | | |
|---|---|---|---|
| 2,548,616 | 4/1951 | Priestman et al. | 175/203 X |
| 3,777,827 | 12/1973 | Thiery et al. | 175/103 |
| 3,848,683 | 11/1974 | Takagi et al. | 175/103 X |
| 3,856,095 | 12/1974 | Adair et al. | 175/203 |
| 3,872,932 | 3/1975 | Gosselin | 175/103 X |
| 3,941,146 | 3/1976 | Chatard et al. | 175/103 X |
| 4,735,270 | 4/1988 | Fenyvesi | 175/203 X |
| 5,215,151 | 6/1993 | Smith et al. | 175/45 |
| 5,265,687 | 11/1993 | Gray | 175/62 |

FOREIGN PATENT DOCUMENTS

| | | | |
|---|---|---|---|
| 1167285 | 4/1964 | Germany | 175/203 |
| 2262758 | 6/1973 | Germany | 175/103 |
| 2751564 | 5/1978 | Germany | 175/203 |

OTHER PUBLICATIONS excerpt from Oilweek-Aug. 2, 1976 (2 pages).
clipping from The Roughneck-Jul. 1976.
clipping from newspaper entitled "Idea of oilman Ben Gray".
clipping from Edmonton Journal-Aug. 22, 1978.

*Primary Examiner*—Hoang C. Dang
*Attorney, Agent, or Firm*—Adrian D. Battison; Stanley G. Ade; Murray E. Thrift

[57] ABSTRACT

A conventional drilling system using continuous coiled tubing connected to a reel at its upper end and connected to a drilling tool at its lower end is steered by rotating the injector at the well head which drives the tubing into the well about an axis longitudinal of the well bore to effect twist in the tubing along the well bore and thus to rotate the drilling tool. This twist in the tubing between the injector and the reel is negated by rotating the reel about a vertical axis parallel to the well bore in a direction, viewed from above, which is opposite to the direction of the injector.

7 Claims, 2 Drawing Sheets

STEERING DRILL BIT WHILE DRILLING A BORE HOLE

BACKGROUND OF THE INVENTION

This invention relates to a method of drilling a bore hole and more particularly to a method of steering the drill bit while drilling a curved bore hole to vary the azimuth.

A method is disclosed in U.S. Pat. No. 5,215,151 (Smith et al) in which the drilling of a bore hole is effected using continuous coiled tubing which extends from a trailing end on a supply reel at the earth's surface to a leading end within the well bore.

The drilling of well bores using continuous coiled tubing is known conventionally and includes the supply of a drilling fluid which is pumped into the trailing end of the coiled tubing for transmitting the drilling fluid to the leading end of the tubing at the base of the well bore. At the base is provided a drilling tool which includes a drill bit rotatable relative to the drilling tool, the drill bit being driven by a motor powered by the flow of the drilling fluid through the drilling tool.

It is further previously known that a substantially vertical well bore can be turned with a curved bore section into an inclined or horizontal well bore by providing a drilling tool which includes a bend section. The bend section of the drilling tool tends to steer the well bore so that it turns to a direction at right angles to a plane containing the bend axis and longitudinal of the drilling tool.

The above U.S. patent discloses a technique of steering the drilling tool to vary the azimuth of the curved bore section by providing an orientation device as a part of the drilling tool. The drilling tool thus comprises an upper part fixed relative to the drill tubing and a lower part including the drill bit and the bend section. A control system is provided by which the lower section can be rotated relative to the upper section by controlled predetermined amounts in response to signals provided from the surface.

This arrangement is generally satisfactory and has achieved some success but is relatively complex involving signaling from the surface and relatively complex mechanical structures in the drilling tool.

It has also been proposed to steer the drilling tool by rotating the injector about the axis of the drill string. This acts to rotate the tubing which in turn rotates the drilling tool to the required angle. However this has only been considered in an arrangement in which the reel and reel support is also rotated about the same axis. As the reel is heavy and offset to one side of the drill string, this rotation has been considered to be impractical and the technique basically abandoned.

SUMMARY OF THE INVENTION

It is one object of the present invention, therefore, to provide an improved drilling method which enables a steering action of the azimuth of a curved bore section without the complication of a down hole orientation system.

According to one aspect of the invention there is provided a method of drilling a bore hole in the earth comprising providing a continuous drill tubing coiled on a supply reel and having a trailing tubing end at the supply reel and a leading tubing end for insertion into the bore hole; connecting a supply of drilling fluid to the trailing tubing end for pumping the drilling fluid to the leading tubing end; providing a drilling tool having an elongate tool body, a motor mounted on the tool body to generate drive power, a drilling bit mounted on the tool body at a leading end thereof for rotation relative to the tool body in responsive to the drive power from the motor and means defining a bend section in the tool body defining a bend axis transverse to the longitudinal axis of the tool body such that the tool body tends to steer the drilling direction of the drill bit and the tool body in a direction at right angles to a plane parallel to the longitudinal axis of the tool and containing the bend axis; connecting a trailing end of the drilling tool body to the leading end of the tubing so as to communicate drilling fluid from the tubing to the tool body and so as to prevent rotation of the tool body relative to the leading end of the tubing; passing the tubing through an injector into the bore hole as so to feed the tubing into the bore hole; rotating the tubing at the injector by rotating the injector about an axis longitudinal of the tubing so as to cause rotation of the leading end of the tubing, the drilling tool and the transverse bend axis about the longitudinal axis so as to effect steering of the drilling direction of the drill bit, mounting the reel at a position which is fixed angularly relative to the well bore and rotating the reel and a reel support assembly on which the reel is mounted about an axis substantially parallel to the well bore in a direction which is opposite to the direction of rotation of the tubing at the injector when viewed from above.

According to a second aspect of the invention there is provided an apparatus for drilling a bore hole in the earth comprising a continuous drill tubing coiled on a supply reel and having a trailing tubing end at the supply reel and a leading tubing end for insertion into the bore hole; means for connecting a supply of drilling fluid to the trailing tubing end for pumping the drilling fluid to the leading tubing end; a drilling tool having an elongate tool body, a motor mounted on the tool body to generate drive power, a drilling bit mounted on the tool body at a leading end thereof for rotation relative to the tool body in responsive to the drive power from the motor and means defining a bend section in the tool body defining a bend axis transverse to the longitudinal axis of the tool body such that the tool body tends to steer the drilling direction of the drill bit and the tool body in a direction at right angles to a plane parallel to the longitudinal axis of the tool and containing the bend axis; means connecting a trailing end of the drilling tool body to the leading end of the tubing so as to communicate drilling fluid from the tubing to the tool body and so as to prevent rotation of the tool body relative to the leading end of the tubing; an injector for passing the tubing into the bore hole so as to feed the tubing into the bore hole; rotating means for rotating the injector and the tubing at the injector about an axis longitudinal of the tubing so as to cause rotation of the leading end of the tubing, the drilling tool and the transverse bend axis about the longitudinal axis so as to effect steering of the drilling direction of the drill bit; a reel support assembly mounting the reel at a position which is fixed angularly relative to the well bore and means for rotating the reel about an axis substantially parallel to the well bore in a direction which is opposite to the direction of rotation of the tubing at the injector when viewed from above.

One embodiment of the invention will now be described in conjunction with the accompanying drawings in which:

BRIEF DESCRIPTION OF THE DRAWINGS

In the drawings like characters of reference indicate corresponding parts in the different FIGURES.

DETAILED DESCRIPTION

Figure 1:
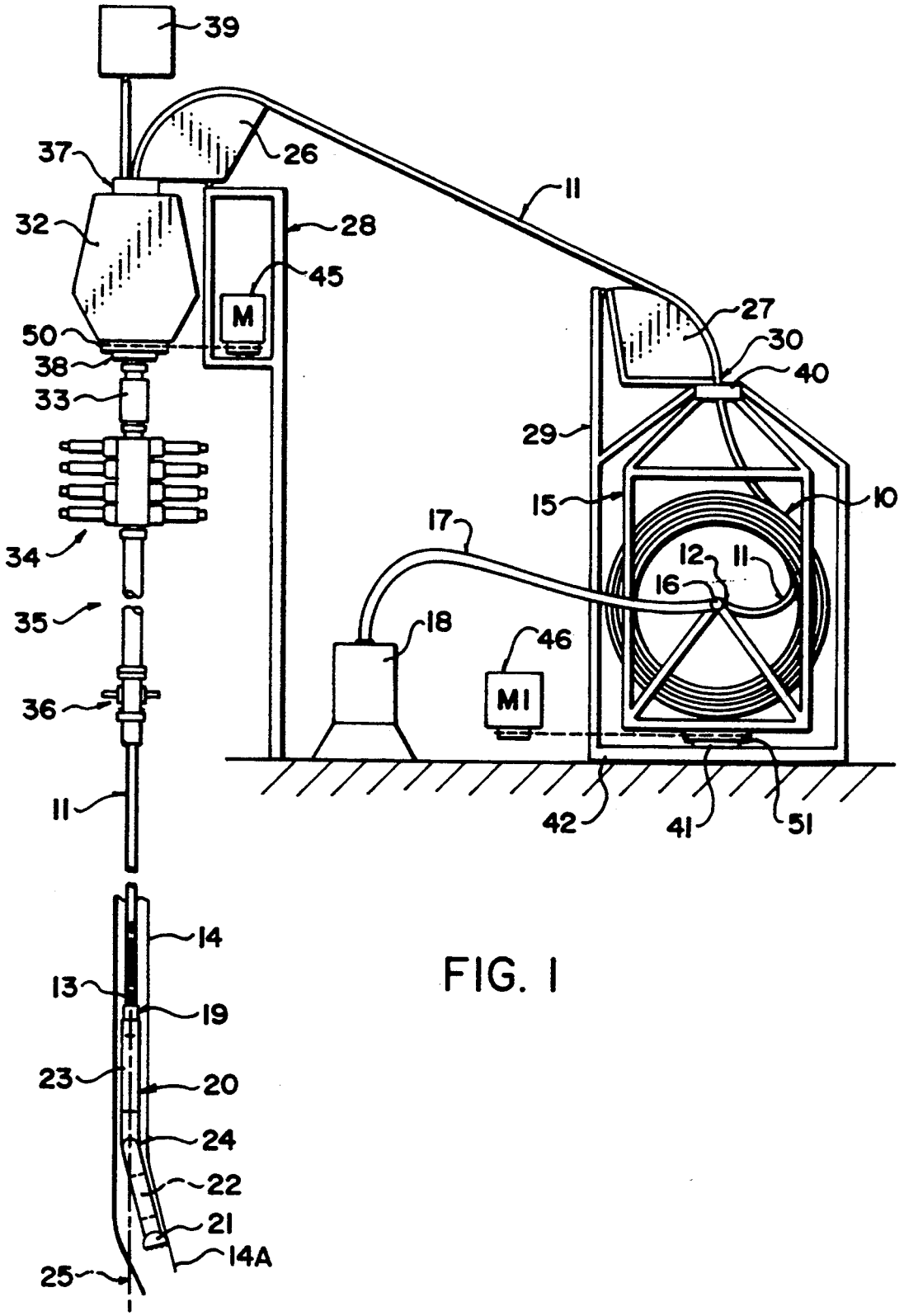
FIG. 1 is a schematic side elevational view of a drilling system according to the present invention.

The drilling system includes many conventional arrangements and in particular includes a conventional continuous coiled tubing drilling system having a reel 10 on which a coiled tube 11 is wound. The length of the coil tube 11 is equal to or greater than the expected drilling depth so that the coil tube can extend from a trailing end 12 of the tubing to a leading end 13 of the tubing which is shown at the bottom of a well bore 14. The reel is mounted on a support frame 15 again of conventional structure which holds the reel for rotation about a horizontal axis of the reel to allow the tubing to be released and drawn in as required. A drive system for rotating the reel to draw in the tubing is provided but is not shown as this is well known to one skilled in the art.

The trailing end 12 of the tubing is brought to a position at the axis and is connected through a swivel coupling 16 again shown only schematically to a supply duct 17 from a pump 18 which generates a pressurized flow of drilling fluid. The pump 18 collects the fluid from a recirculation system with the fluid being returned from the well bore in conventional manner which is not illustrated.

As the axis of the reel is horizontal, the tubing is pulled off tangentially from the reel and hence no twist is introduced into the tubing as it passes from the reel and the support frame 15 of the reel.

At the leading end 13 of the tubing is provided a connector 19 which connects the tubing to a drilling tool 20 again of conventional nature. The drilling tool includes a bit 21 mounted on a drive shaft schematically indicated at 22 driven by a motor schematically indicated at 23. The motor 23 is responsive to the flow of drilling fluid again in conventional manner and acts to provide rotary movement to the shaft 22 carrying the bit 21 for drilling action.

The drilling tool 20 includes a bend section 24 which defines a bend angle relative to a plane containing the bend angle and longitudinal of the drilling tool as indicated at 25.

In conventional manner, the bend angle tends to steer the bit to form a curved well bore section 14A in a direction at right angles to the plane 25 containing the bend angle.

The tubing 11 from the reel passes over a pair of fixed arches 26 and 27 mounted on supports 28 and 29 respectively. The arch 27 is mounted in fixed position over the reel so that the tubing is drawn through a guide 30 fixed over the axis of the reel and then passes over the arch toward the top of the well bore. The arch 26 is positioned at the top of the well bore and directs the tubing from the upwardly inclined section extending between the arches over and down into the well bore. The arches provide a guide surface which controls movement of the tubing during its change in direction.

From the arch 26, the tubing enters an injector schematically indicated at 32 which is again of a conventional nature and acts to grasp the tubing using blocks which frictionally engage the tubing and force the tubing longitudinally both in the downward on the upward direction for feeding and withdrawing the tubing into the well bore. The construction of the injector is well known and this also acts to hold the tubing against rotation in a twisting direction so that the tubing is fed directly longitudinal without any twisting about its axis. In one known arrangement of the injector the tubing is grasped by opposed blocks, each of which has a front face of semi-cylindrical shape so that together the blocks form the majority of a cylinder surrounding the tubing. A plurality of the blocks are then mounted in two rows carried on a pair of opposed chains and movable thereby longitudinally of the wellbore. The blocks are biased into engagement with the tubing by guide plates.

From the injector, the tubing passes into the well bore through a stripper 33, a blow out protector (BOP) 34 and a lubricator 35 to the well head 36. The stripper, BOP and lubricator are of a well known and conventional nature and are therefore shown only schematically and will not be described in detail herein.

In order to steer the azimuth of the curved bore portion 14A, it is necessary to twist the bend angle of the bend portion 24 about the longitudinal axis of the drilling tool 20 and thus of the continuous tube 11.

This step is obtained in the present invention by mounting the injector 32 on upper and lower pivot bearings 37, 38. The bearing 37 is located between the upper part of the injector and the arch 26. The pivot bearing 38 is located between the bottom part of the injector and the top of the stripper. In this way the injector is free to rotate relative to the well head and relative to the arch 26 which remains fixed, The weight of the drill string rests on the wellhead.

Figure 2:
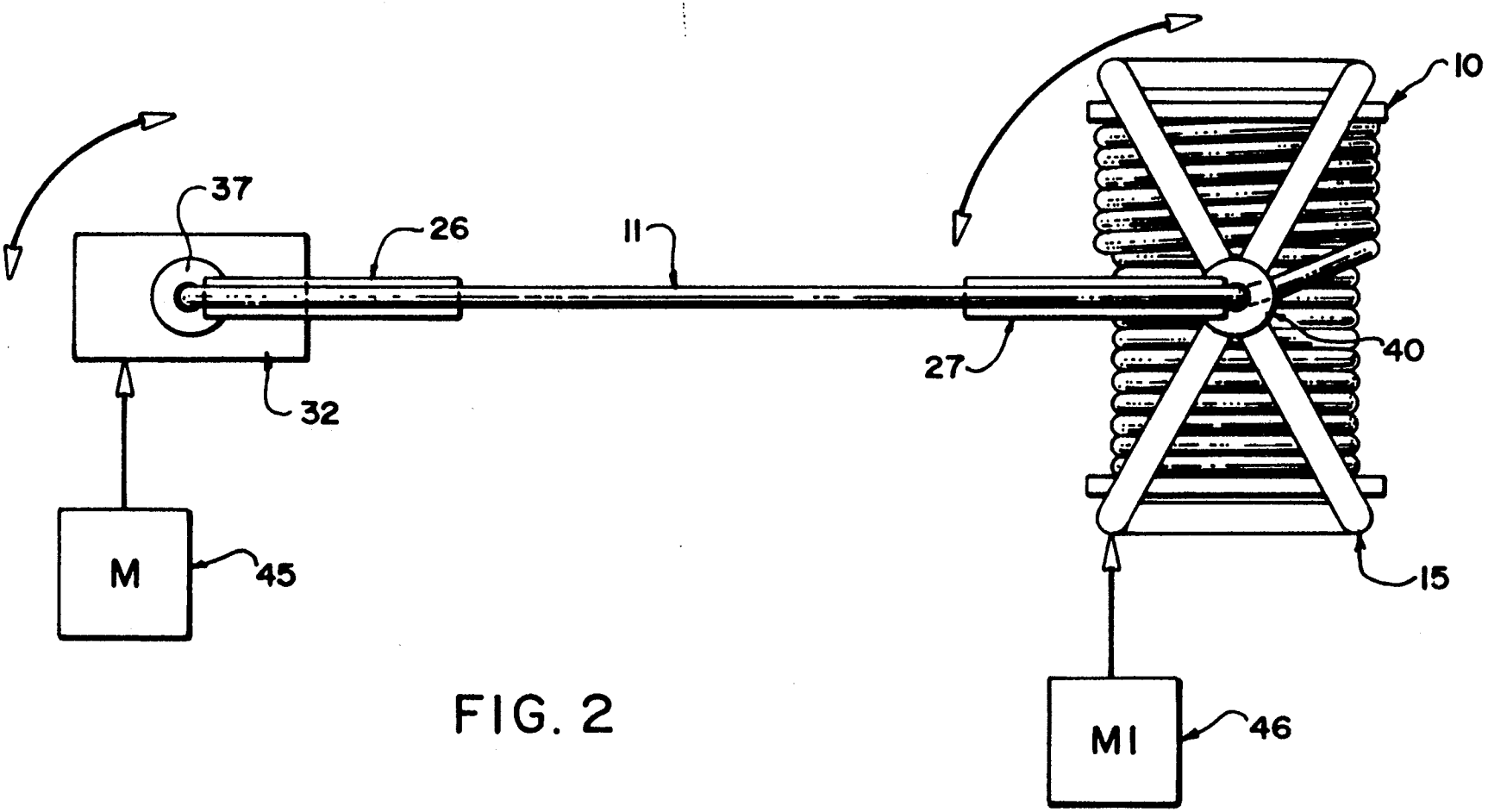
FIG. 2 is a schematic top plan view of the drilling system of FIG. 1.

Similarly the reel and reel frame are mounted on upper and lower pivot bearings 40 and 41. The lower bearing 41 is positioned on top of a fixed base plate 42. The upper bearing 40 is located at the base of the arch relative to the fixed support 29 of the arch. Thus the reel and the reel frame are free to rotate about a vertical axis parallel to the vertical axis of the well bore and offset to one side of the well bore. The reel is mounted in fixed position angularly to one side of the well bore as shown in FIG. 2.

Means for rotating both the injector and the reel support frame 15 about their respective axes are provided and indicated schematically at 45 and 46 respectively. Each of these devices is arranged to rotate the respective element from an initial central position in either direction through an angle less than 360° about the axis. The angle is greater than 180 degrees and preferably of the order of 250 degrees thus giving a total rotation of the order of 500 degrees. This angle allows enough rotation past 180 degrees to avoid repeated full reversals at about the 180 degree position while preventing excessive rotation which could stress the conventional hoses and electrical cables connected to the tubing from a loop at the drill head.

Drive to the injector is provided from a suitable motor M carried on the frame 28 through a chain to a sprocket 50 on the injector at the bottom bearing 38. Drive to the reel support frame is similarly provided from a motor M1 through a chain to a sprocket 51 the frame at the bottom bearing 41.

In operation, the drilling is effected conventionally in that the drill tubing is fit into the well bore and the drill bit driven by the drilling fluid. When it is required to effect steering of the bend angle of the bend portion 24, this is obtained by rotating the injector about its longitudinal axis on the support bearings 37 and 38. At the same time the reel and reel support frame are rotated about their vertical axis. As viewed from above as shown in FIG. 2, if the injector is rotated in a clockwise direction, the reel is rotated in a counterclockwise direction and this acts to eliminate any twist in the inclined section of the tubing between the arches 26 and 27. Similarly rotation of the injector in the counterclockwise direction is matched by rotation of the reel in the clockwise direction. The rotation of the injector generates twist in the tubing passing from the injector through the well bore to the drilling tool 20. The coupling 13 is arranged to provide a fixed or non rotatable connection between the leading end of the tubing and the trailing end of the drilling tool. The coupling 13 of course also communicates the drilling fluid from the tubing into the drilling tool.

The twist therefore of the tubing is communicated to the drilling tool to effect rotation of the bend angle. The angle of movement of the injector is calculated relative to the length of the tubing so that any twist in the tubing is taken up in the length of the tubing and is then subtracted from the angle of rotation of the injector to provide a predetermined angle of rotation of the bend angle.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A method of drilling a bore hole in the earth comprising providing a continuous drill tubing coiled on a supply reel and having a trailing tubing end at the supply reel and a leading tubing end for insertion into the bore hole; connecting a supply of drilling fluid to the trailing tubing end for pumping the drilling fluid to the leading tubing end; providing a drilling tool having an elongate tool body, a motor mounted on the tool body to generate drive power, a drilling bit mounted on the tool body at a leading end thereof for rotation relative to the tool body in responsive to the drive power from the motor and means defining a bend section in the tool body defining a bend axis transverse to the longitudinal axis of the tool body such that the tool body tends to steer the drilling direction of the drill bit and the tool body in a direction at right angles to a plane parallel to the longitudinal axis of the tool and containing the bend axis; connecting a trailing end of the drilling tool body to the leading end of the tubing so as to communicate drilling fluid from the tubing to the tool body and so as to prevent rotation of the tool body relative to the leading end of the tubing; passing the tubing through an injector into the bore hole as so to feed the tubing into the bore hole; rotating the tubing at the injector by rotating the injector about an axis longitudinal of the tubing so as to cause rotation of the leading end of the tubing, the drilling tool and the transverse bend axis about the longitudinal axis so as to effect steering of the drilling direction of the drill bit, mounting the reel at a position which is fixed angularly relative to the well bore and rotating the reel and a reel support assembly on which the reel is mounted about an axis substantially parallel to the well bore in a direction which is opposite to the direction of rotation of the tubing at the injector when viewed from above.

2. The method according to claim 1 wherein the injector is mounted on pivot means.

3. The method according to claim 1 wherein the injector includes an arch member over which the tubing passes and wherein the reel support assembly includes an arch member over which the tubing passes from the reel and wherein the arch members are maintained substantially stationary while the reel and the injector are rotated in said opposed directions.

4. The method according to claim 1 wherein the tubing is rotated from a central position through an angle on each side of the central position which is less than 360 degrees.

5. Apparatus for drilling a bore hole in the earth comprising a continuous drill tubing coiled on a supply reel and having a trailing tubing end at the supply reel and a leading tubing end for insertion into the bore hole; means for connecting a supply of drilling fluid to the trailing tubing end for pumping the drilling fluid to the leading tubing end; a drilling tool having an elongate tool body, a motor mounted on the tool body to generate drive power, a drilling bit mounted on the tool body at a leading end thereof for rotation relative to the tool body in responsive to the drive power from the motor and means defining a bend section in the tool body defining a bend axis transverse to the longitudinal axis of the tool body such that the tool body tends to steer the drilling direction of the drill bit and the tool body in a direction at right angles to a plane parallel to the longitudinal axis of the tool and containing the bend axis; means connecting a trailing end of the drilling tool body to the leading end of the tubing so as to communicate drilling fluid from the tubing to the tool body and so as to prevent rotation of the tool body relative to the leading end of the tubing; an injector for passing the tubing into the bore hole so as to feed the tubing into the bore hole; rotating means for rotating the injector and the tubing at the injector about an axis longitudinal of the tubing so as to cause rotation of the leading end of the tubing, the drilling tool and the transverse bend axis about the longitudinal axis so as to effect steering of the drilling direction of the drill bit; a reel support assembly mounting the reel at a position which is fixed angularly relative to the well bore and means for rotating the reel about an axis substantially parallel to the well bore in a direction which is opposite to the direction of rotation of the tubing at the injector when viewed from above.

6. The apparatus according to claim 5 wherein the injector is mounted on pivot means.

7. The apparatus according to claim 5 wherein the injector includes an arch member over which the tubing passes and wherein the reel support assembly includes an arch member over which the tubing passes from the reel and means maintaining the arch members substantially stationary while the reel and the injector are rotated in said opposed directions.

* * * * *